US008979527B2

(12) United States Patent
Bich et al.

(10) Patent No.: US 8,979,527 B2
(45) Date of Patent: Mar. 17, 2015

(54) GAS LIGHTER AND METHOD FOR MANUFACTURING SAME

(75) Inventors: François Bich, Clichy (FR); Michel Doucet, Bains sur Oust (FR)

(73) Assignee: Societe Bic, Clichy (FR)

( * ) Notice: Subject to any disclaimer, the term of this patent is extended or adjusted under 35 U.S.C. 154(b) by 1155 days.

(21) Appl. No.: 12/922,031

(22) PCT Filed: Mar. 10, 2008

(86) PCT No.: PCT/IB2008/052196

§ 371 (c)(1),
(2), (4) Date: Sep. 10, 2010

(87) PCT Pub. No.: WO2009/112892

PCT Pub. Date: Sep. 17, 2009

(65) Prior Publication Data

US 2011/0008738 A1 Jan. 13, 2011

(51) Int. Cl.
*F23Q 2/16* (2006.01)

(52) U.S. Cl.
CPC ..... *F23Q 2/163* (2013.01)
USPC ..... 431/143; 431/343; 431/345; 29/428; 251/359; 251/127; 137/454.2; 137/454.6

(58) Field of Classification Search
USPC ..... 431/143, 344; 251/127, 353, 360; 137/454.2, 454.6
See application file for complete search history.

(56) References Cited

U.S. PATENT DOCUMENTS

| | | | | | |
|---|---|---|---|---|---|
| 3,601,165 | A | * | 8/1971 | Obata | 141/302 |
| 4,077,429 | A | * | 3/1978 | Kimball | 137/588 |
| 4,106,674 | A | * | 8/1978 | Schultz | 222/386.5 |
| 4,153,233 | A | * | 5/1979 | Neyret | 251/127 |
| 4,193,514 | A | * | 3/1980 | Langstroth | 222/4 |
| 4,680,007 | A | * | 7/1987 | Schachter | 431/344 |
| RE33,282 | E | * | 7/1990 | Schachter | 431/344 |
| 2004/0072114 | A1 | * | 4/2004 | Doucet et al. | 431/344 |

* cited by examiner

*Primary Examiner* — Gregory Huson
*Assistant Examiner* — Nikhil Mashruwala
(74) *Attorney, Agent, or Firm* — Jones Day

(57) ABSTRACT

The gas dispensing apparatus comprises a réservoir (2) having an upper wall (5), a well (6) passing through the upper wall, and a gas dispensing device (8) located at least partially in the well (6) and having an external rigid portion (8*a*) facing the inner wall of the well. The gas dispensing apparatus comprises a résilient tubular élément (22) fitted into the well (6). The rigid portion (8*a*) of the device (8) is inserted therein. The well has an edge (34) extending outwardly and against which a stopping portion (30) of the tubular élément is flexed under action of the rigid portion of the device inserted into the tubular élément. The flexed lower portion preferably defines an annular protubérance that prevents upward movement of the tubular élément relative to the well. A gas lighter of simplified construction and suitable for a brittle réservoir material such as amorphous polymers is obtained.

14 Claims, 5 Drawing Sheets

GAS LIGHTER AND METHOD FOR MANUFACTURING SAME

CROSS-REFERENCE TO RELATED APPLICATION

This application is a national stage application of International Application No. PCT/IB2008/052196, filed on filed on Mar. 10, 2008, the entire contents of which are incorporated herein by reference.

BACKGROUND OF THE EMBODIMENTS OF THE PRESENT INVENTION

1. Field of the Invention

The embodiments of the present invention relate to gas lighters and methods for assembling components of a gas lighter.

2. Description of Related Art

More particularly, the embodiments of the present invention relate to a gas lighter, suitable notably for lighting a cigarette, such a gas lighter comprising a reservoir having an upper wall through which there passes a well and intended to contain a fuel, and a gas dispensing device provided with at least one tubular element arranged in the well.

To hold the tubular element of the distributing device in the well of the reservoir, it is a known practice for use to be made of a fitting comprising a threaded ring screwed into a tapped upper part of the well, and to prevent a gas leak between the tubular element and the well with a sealing element comprising an o-ring as depicted in FIG. 1 of document WO-A-01/18452.

One advantage of this type of fitting is that it can be used in particular with a reservoir made of amorphous polymer. Amorphous polymers, among which include SANs (styrene acrylonitriles) and ABSs (acrylonitrile butadiene styrene), have several advantages when producing reservoirs for gas lighters. They are generally inexpensive, easy to use and certain amorphous polymers, such as SANs, are transparent, which has the advantage that the level of fuel in liquid phase remaining in the reservoir can be seen. However, these amorphous polymers are relatively brittle at ambient temperature because their elongation at the elastic limit is small, generally less than 5%. Fitting the tubular element using a threaded ring creates practically no tensile stress in the wall of the well, unlike force-fitting.

However, the threaded ring and the screw thread of the tapped part of the well requires the use of relatively complex molds which lengthen the stripping operations. In addition, the operation of screwing the ring into the well when assembling the lighter is relatively difficult and lengthy to perform in an automated manufacturing process. Moreover, at least one sealing element is required to prevent any gas leak around the tubular element. As a result, manufacturing cost of the gas lighter is significantly increased.

Therefore, a need exists for a gas lighter of simplified construction, while at the same time affording a good seal, reduced bulk, safety of use and, as far as possible, remaining suitable for a brittle reservoir material such as amorphous polymers in a non-limitative example.

SUMMARY OF THE EMBODIMENTS OF THE PRESENT INVENTION

The embodiments of the present invention provide a gas lighter comprising:

a reservoir intended to contain fuel and having an upper wall;

a well passing through the upper wall, the well extending along a central axis and having an inner wall; and a gas dispensing device located at least partially in the well and having an external rigid portion facing at least a part of the inner wall.

The embodiments of the present invention preferably include a resilient tubular element having at least one stopping portion, the resilient tubular element being fitted into the well and the rigid portion of the gas dispensing device being inserted therein, the well having at least one first edge extending outwardly from the central axis and against which the stopping portion of the tubular element is flexed under action of the rigid portion of the gas dispensing device inserted into the resilient tubular element.

By virtue of this arrangement, the upper wall of the reservoir could have relatively smooth walls and be easier to manufacture (there is no tapped part in the well).

Furthermore, fitting the gas dispensing device onto the reservoir is also easier because all that is required is for the resilient tubular element to be placed into the well, after which the locking of the resilient tubular element is obtained when the gas dispensing device is inserted in its locking position.

According to another embodiment, the first edge is annular.

According to another embodiment, the first edge is oriented toward the inside of the reservoir. Accordingly, the tubular element may be inserted from the upside and an upward movement of this tubular element is prevented.

According to another embodiment, the first edge is an inner end of the well. This arrangement facilitates molding operations for the upper wall.

According to another embodiment, the well has at least one second edge oriented in the opposite direction relative to the first edge, the resilient tubular element having at least one stopping portion in engagement against the second edge.

According to another embodiment, the second edge is facing the first edge, the first edge and second edge defining a recess in the inner wall of the well, in which the stopping portion of the tubular element is flexed under action of the rigid portion of the gas dispensing device inserted into the resilient tubular element. In such an embodiment, the flexed portion is expanding radially inside the upper wall and the resilient tubular element can be of lower length to save material.

According to another embodiment, the stopping portion defines an annular protuberance.

According to another embodiment, the stopping portion of the resilient tubular element protrudes inwardly in a non-mounted state, and the external rigid portion is cylindrical. With such arrangement, the gas dispensing device may be a standard component of cylindrical shape.

According to another embodiment, the external rigid portion comprises a rigid annular projection. One advantage of this arrangement is that a suitable anchoring position is obtained with a smooth flexing of the stopping portion of the resilient tubular element.

According to another embodiment, the resilient tubular element comprises a cylindrical portion facing the inner wall of the well, the cylindrical portion having a constant thickness. The resilient tubular element is thus easier to produce.

According to another embodiment, the well has a cylindrical shape presenting an internal diameter d1, the external rigid portion of the gas dispensing device having a cylindrical shape presenting an external diameter d2, the stopping portion of the resilient tubular element being provided with a thickness T and satisfying a relation 2*T+d2>d1. The stopping portion is thus pressed radially outwards by the external rigid portion, such that this stopping portion penetrates by flexion into a space or recess that is radially spaced relative to the global cylindrical shape of the well.

According to another embodiment, the stopping portion of the resilient tubular element is in gastight contact with the well. This prevents leakage of fuel without any additional O-ring.

According to another embodiment, the resilient tubular element is one piece made of synthetic elastomer, preferably thermoplastic polyester elastomer. This specific material provides gas tightness, sufficient strength (like plastics), good resilience (like rubbers), ability to be injection molded, strong resistance to tearing, flex-cut growth, creep and abrasion. These properties and an adapted sizing of the resilient tubular element prevent vertical movement of the gas dispensing device.

An object of an embodiment of the present invention is to provide a simple method of mounting a gas dispensing assembly in a well of a gas lighter reservoir.

It is further proposed according to the invention a method of mounting a gas lighter that comprises:

a reservoir intended to contain fuel and having an upper wall;

a well passing through the upper wall, the well extending along a central axis and having an inner wall defining at least one first edge extending;

outwardly from the central axis; and a gas dispensing device located at least partially in the well and having an external rigid portion facing at least a part of the inner wall;

the method comprising the steps of:

inserting the resilient tubular element in the well;

inserting the gas dispensing device in the well;

flexing a stopping portion of the tubular element against the first edge under action of the rigid portion of the gas dispensing device; and locking the resilient tubular element into the well through the flexed stopping portion.

Other embodiment and advantages of the present invention will become apparent to those skilled in the art during the description which will follow, given by way of a non-limiting example, with reference to the appended drawings.

DETAILED DESCRIPTION OF THE INVENTION

Figure 1:
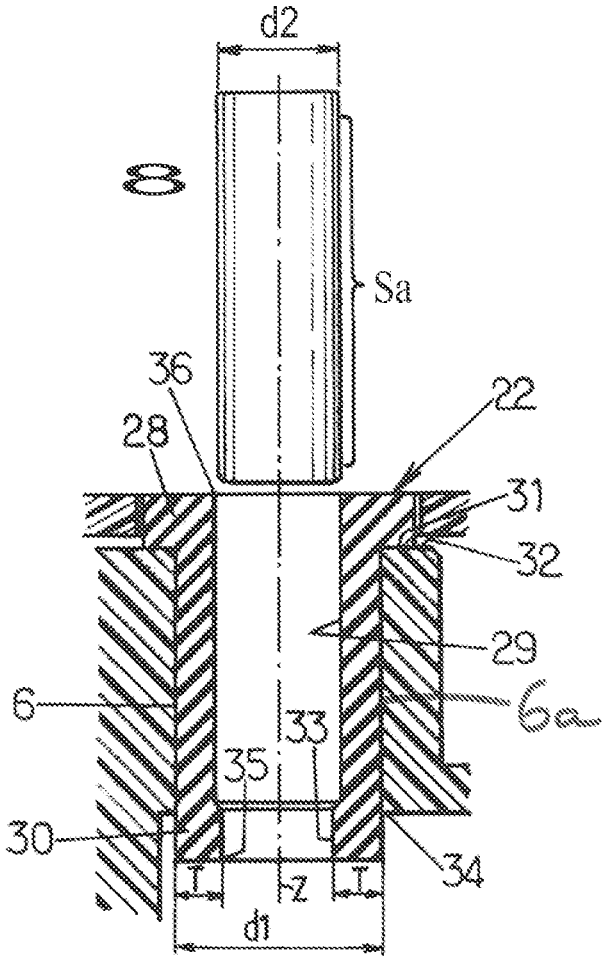
FIG. 1 is a simplified vertical cross-sectional view of a first embodiment according to the present invention, in a non-mounted state for the gas dispensing device.

In the various figures, the same references are used to designate identical or similar elements.

For purposes of promoting an understanding of the embodiments of the present invention, reference will now be made to four exemplary, non-limiting embodiments illustrated in FIGS. 1 to 6. As shown in FIGS. 2 and 4, the gas lighter 1 comprises a reservoir 2 intended to contain a fuel under pressure and, partially, in liquid phase, such as isobutane.

As shown in FIGS. 2 and 4, the reservoir 2 may be formed of a bowl 3, the bowl 3 preferably being U-shaped in cross-section, and having a bottom wall, not visible in FIG. 2, and an annular side wall that extends upwards from the bottom wall to an upper end 4.

The upper end 4 may be closed off by an upper wall 5 which, in the example depicted, may be a separate part fixed to the bowl 3 by any method known in the art including, but not limited to, bonding, gluing, welding, friction, press fit, etc. Alternatively, the upper wall 5 may be manufactured as an integral part with the bowl 3.

The reservoir 2 is preferably manufactured from at least one rigid amorphous polymer material, including, for example, from ABSs (acrylonitrile butadiene styrenes), SANs (styrene acrylonitriles), etc. The reservoir can thus be injection molded. Alternatively, by way of example, the bowl 3 may be manufactured from SAN, while the upper wall 5 may be manufactured from ABS, and vice versa, it being possible, in known manner, to bond these materials together, for example by ultrasonic sealing, bonding, ultrasonic welding, gluing, etc.

The advantage of such amorphous polymers is that they are relatively inexpensive and easy to implement, process, manufacture, and form parts from. In addition, the amorphous polymer material, such as SAN, may be transparent, making it possible for the gas lighter user to see the level of liquid fuel remaining in the reservoir.

Other amorphous-type polymers may be used, provided that their mechanical and chemical properties are compatible with them being used as in a gas lighter.

The upper wall 5 of the reservoir may further have a well 6, that in the example shown extends along a vertical axis Z and which advantageously may be in the shape of a cylinder that is circularly symmetrical.

The well 6, in general, is capable of receiving a gas dispensing device 8 that is actuated by an operating device 9 carried by the head 10 of the lighter, which overlies the reservoir 2. In the embodiment depicted, the head 10 preferably is retained against the upper wall 5 of the reservoir by catches 11 (i.e., studs) on the head 10 that cooperate by snap-fitting or clipping with complementary catches 12 molded in the upper wall 5 of the reservoir 2.

The head 10 may also form a support for fitting an ignition device 14 and a windshield 13, the windshield 13 forming a screen or shield against the wind or draft.

The ignition device 14, which is generally widely known in the art, may comprise, for example, a spark wheel 15 and a flint 16 held pressed against the spark wheel 15 by a spring 17 received in a circular cavity 18 in the head 12. A complementary cavity 19 is formed in the upper wall 5 of the reservoir 2 to accommodate the cavity 18 of the head 12. However, it is of course possible to use other types of ignition devices, such as a piezoelectric device, etc.

As further shown in FIGS. 2 and 4, the dispensing device 8 is associated with a tubular element 22 and may include an outer tube 23, which is made of metal or suitable alloy. The lower part 24 of the outer tube 23 preferably has a regulating device for regulating the gas flow rate, which regulating device may be, for example, a microporous membrane 25. This microporous membrane 25 preferably includes a film of polypropylene stretched uniaxially and having pores of elongate shape, as described in U.S. Pat. No. 4,496,309. The microporous membrane 25 preferably is held against an interior shoulder 23*a* of the outer tube 23, the shoulder 23*a* being formed in the vicinity of the lower end 24 of the outer tube 23, thus enabling the microporous membrane 25 to cover an orifice 26 formed in the center of the shoulder 23*a*. The microporous membrane 25 is preferably pressed against the bottom face of the shoulder 23*a* by a rigid ring 27, which is itself retained at the bottom of the outer tube 23 by crimping the lower end 24 of the outer tube 23.

The dispensing device 8 preferably includes a valve 40 having a gas outlet duct 41 opening near the ignition means 14. The duct 41 preferably includes a shutter 42 located in the lower part of the dispensing device 8. Preferably, the shutter 42 is made from an elastomeric material designed to shut off the gas passage orifice 26 as the duct 41 is moved along the longitudinal axis Z of the tubular element 22. Preferably, the duct 41 also contains slots 43 formed near the shutter 42 in order to provide communication with the inside of the outer tube 23.

Furthermore, the operating device 9 includes a fork 45 mounted to tilt about a pin secured to the head 12. The fork 45 includes a first end 46 and a second end 49. The first end 46 cooperates with a lower shoulder 47 and an upper shoulder 48 formed on the upper end of the duct 41 which emerges from the outer tube 23 thus permitting the gas dispensing device 8 to be raised as the user depresses the second end 49 of the fork 45. When the user depresses the second end 49 of the fork 45 raising the duct 41, the valve 40 is opened releasing gas from the reservoir 2.

Preferably, a compression spring 50 is arranged between the underside of the second end 49 of the fork 45 and the upper wall 5 of the reservoir 2 thus biasing the fork 45 upwards and hence biasing the valve into a closed position when the lighter is not in use.

Figure 2:
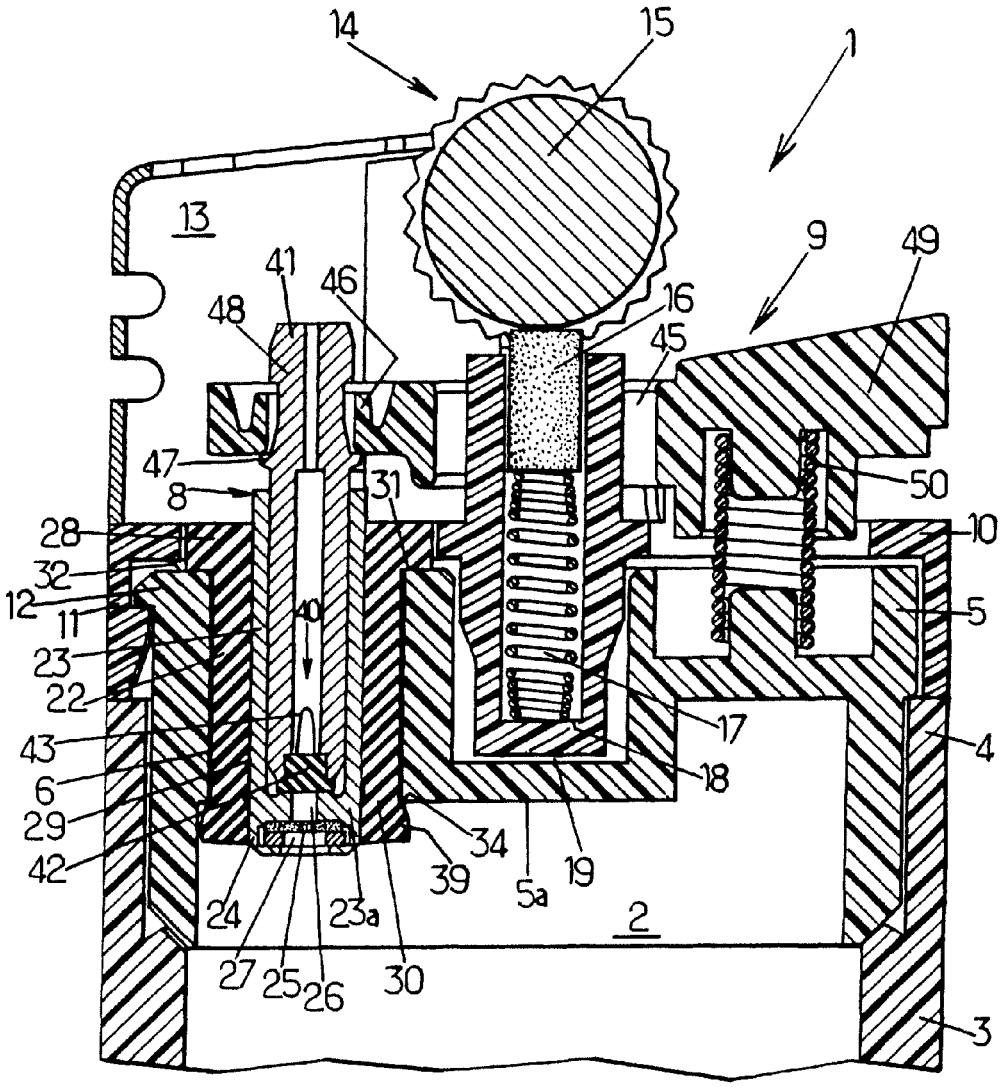
FIG. 2 is a vertical cross-sectional view of a top portion of a gas lighter, according to the first embodiment in a mounted state.

In a first preferred embodiment, shown in FIGS. 1 and 2, the dispensing device 8 is associated with a resilient tubular element 22. This tubular element 22 preferably is in the shape of a cylinder that is circularly symmetrical for engaging the upper wall 5 of the reservoir 2 in the well 6. The tubular element 22 is made of an elastic plastic material which is not deteriorated by gas. Preferably, the tubular element 22 is a resilient single-piece made of thermoplastic polyester elastomer. For instance, elastomer named Hytrel® is a suitable choice. Alternatively, the tubular element 22 is made of another polymer having analogous properties, especially a high strength and a suitable flexibility. As shown in particular in FIGS. 1 and 5, the tubular element 22 may be introduced at first into the well 6, after which the dispensing device 8 may be inserted. The dispensing device 8 may include an outer tube 23, which is made of metal or suitable alloy. The resilient material of the tubular element 22 provides flexibility sufficient to permit the outer tube 23 to be smoothly fitted into the tubular element 22.

As shown in FIG. 1, the tubular element 22 comprises at least three portions: a head 28 at a first end preferably located above the well 6, an intermediate portion 29 fully inserted into the well 6, and a stopping portion 30 at a second end. The stopping portion 30 is designed to be flexed by the outer tube 23 of the dispensing device 8. The intermediate portion 29 and the stopping portion 30 (lower portion) form a flexible insertion part, which preferably has an initial outer diameter that substantially corresponds to the internal diameter d1 of the well. The flexible insertion part is preferably longer than the effective length of the well 6. The head 28 may be considered as optional.

A peripheral external rim 31 formed on the head 28 abuts against the annular upper edge 32 of the well 6. The external rim 31 may be defined by a flange ring or similar retaining element to prevent a downward movement of the tubular element 22 in relation to the well 6.

In order to prevent an upward movement of the tubular element 22, a projection 33 that is preferably annular is provided on the inner surface of the stopping portion 30 of the tubular element 22. In other words, the stopping portion 30 protrudes inwardly.

As shown in FIGS. 1 and 2, the tubular element 22 protrudes on both sides of the well 6. The annular projection 33 is formed on the inner surface of the stopping portion 30 at the level where the tubular element 22 protrudes inside the reservoir 2, below the upper wall 5.

The intermediate portion 29 has a cylindrical shape and a thickness lower than the thickness T of the stopping portion 30 provided with this annular projection 33. As shown in FIG. 1, the tubular element 22 is fitted into the well 6 at first, after which the annular projection 33 is displaced outwards radially when the dispensing device 8 is fitted into the tubular element 22. In the mounted state as shown in FIG. 2, the dispensing device 8 presents an external rigid portion 8*a* facing the inner wall 6*a* of the well 6. This external rigid portion 8*a*, which may be formed integrally or not with the outer tube 23, is in particular in contact with the annular projection 33.

As shown in FIG. 2, the outer tube 23 stresses the stopping portion 30 in the area provided with the excess of thickness, resulting in a flexing of the stopping portion 30 in a radial direction beyond one rim or edge 34 of the well 6. In other words, when the dispensing device 8 is assembled inside the tubular element 22, it produces an expansion of the stopping portion 30 and a locking of the tubular element 22 is thus created to prevent any upward movement thereof.

The flexed stopping portion 30 is in tight contact with the outer tube 23 as well as with the annular edge 34 that borders the lower end of the well 6. A sealing and immobilizing of the outer tube 23 in the tubular element 22 is obtained through the stopping portion 30. The dispensing device 8 is also in contact with the head 28 and with the intermediate portion 29, at least between the lower aperture 35 and the upper aperture 36 of the tubular element 22.

Figure 5:
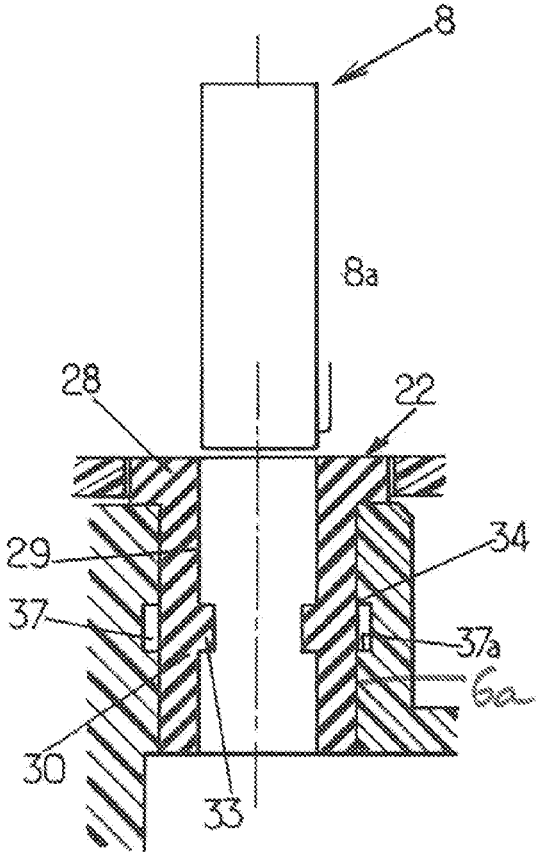
FIG. 5 is a simplified vertical cross-sectional view of a third embodiment according to the present invention, in a non-mounted state for the gas dispensing device.

In an alternative exemplary embodiment, as shown in FIG. 5, the annular projection 33 may be formed on the inner surface of the intermediate portion 29, at a level where the well 6 comprises an inner recess 37. In such an embodiment, the stopping portion 30 is an intermediate part of the tubular element 22 and a portion of this stopping portion 30 protrudes radially to penetrate in the inner recess 37. A sealing and immobilizing of the outer tube 23 in the tubular element 22 is also obtained in this case through the annular projection 33. Two projections or more may be provided at different levels on the stopping portion 30, with corresponding inner recesses 37 and/or outer recesses of the wall 6. The head 28 may be suppressed as the retaining function may entirely be performed by the annular projection 33 locked between two edges (34, 37*a*), each of them facing the other one. The first edge 34 is oriented toward the inside of the reservoir 2, while the second edge 37*a* is oriented in the opposite direction.

Figure 3:
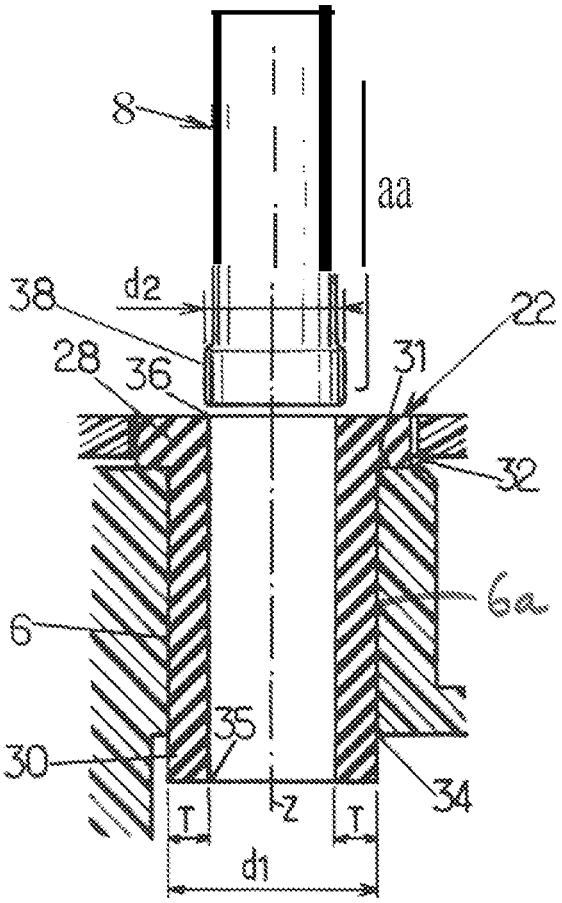
FIG. 3 is a simplified vertical cross-sectional view of a second embodiment according to the present invention, in a non-mounted state for the gas dispensing device.
Figure 4:
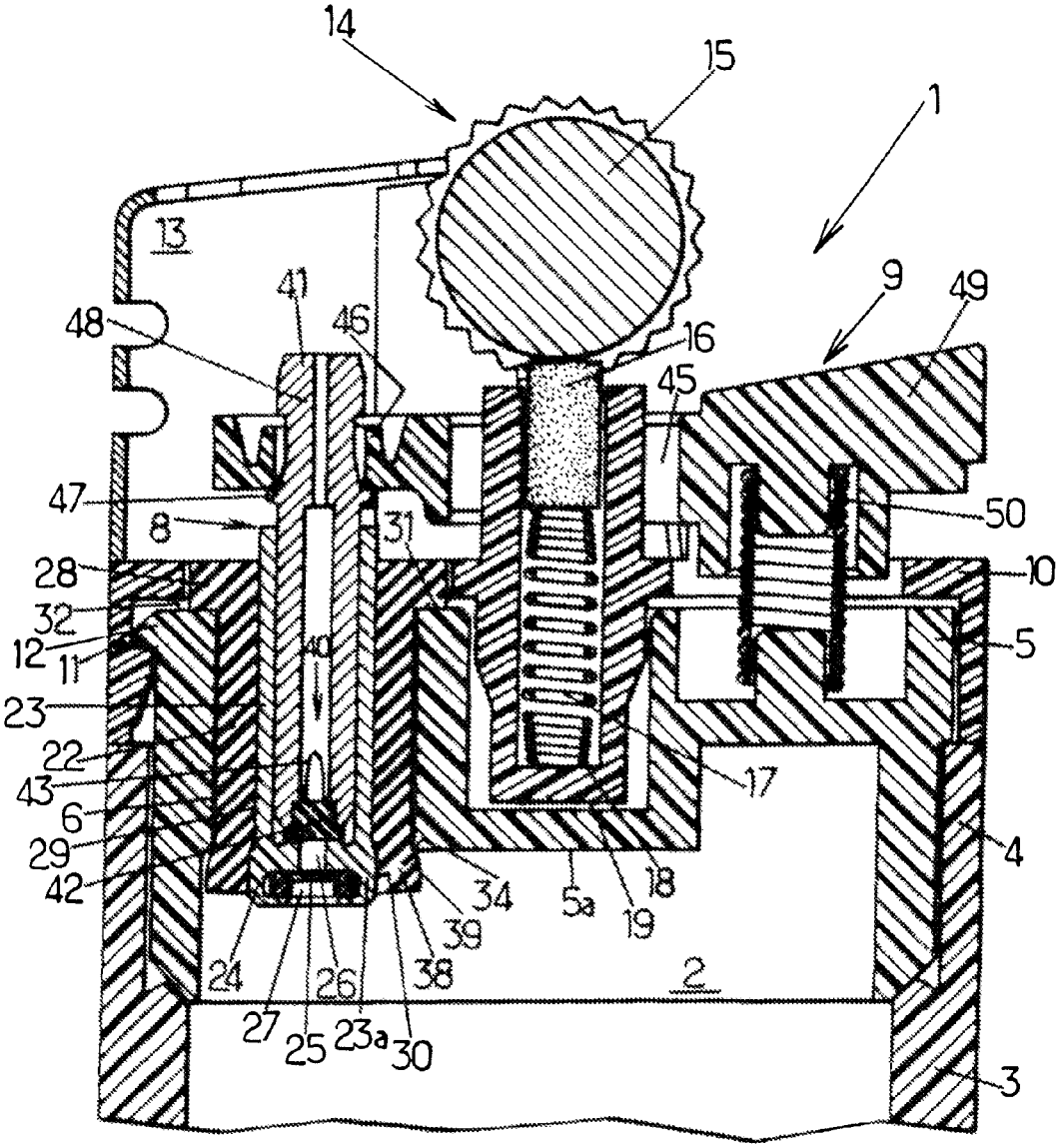
FIG. 4 is a vertical cross-sectional view of a top portion of a gas lighter, according to the second embodiment in a mounted state.

Referring now to FIGS. 3 and 4 relating to another embodiment, at least one projection 38 that may be annular is formed on the outer tube 23 at the level of the lower part 24. The annular projection 38 may be continuous or not. The dispensing device 8 thus exhibits an increase of its outer diameter at the level where it protrudes inside the reservoir, below the upper wall 5. The intermediate portion 29 and the stopping portion 30 of the tubular element 22 preferably have the same thickness T. In this case, the excess of thickness is provided by the annular projection 38.

As shown in particular in FIG. 4, the tubular element 22 may be introduced at first into the well 6, after which the dispensing device 8 may be inserted. When the dispensing device 8 is mounted inside the tubular element 22, action of the annular projection 38 produces a flexing of the stopping portion 30 of the tubular element 22. As a result, in a mounted state of the dispensing device 8, the stopping portion 30 expands radially outwards relative to the intermediate portion 29 and defines an annular protuberance 39. This annular protuberance 39 prevents an upward movement of the tubular element 22 relative to the well 6. Moreover, such flexing causes the stopping portion 30 of the tubular element 22 to be in gastight contact with the well 6.

Figure 6:
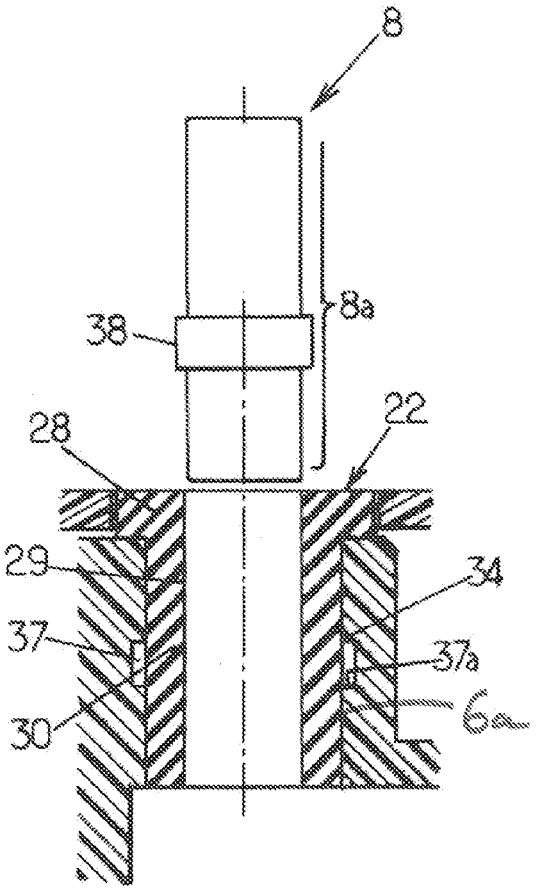
FIG. 6 is a simplified vertical cross-sectional view of a fourth embodiment according to the present invention, in a non-mounted state for the gas dispensing device.

In an alternative exemplary embodiment as shown in FIG. 6, the annular projection 38 may be formed on an intermediate portion of the outer tube 23, at a level where the well 6 comprises an inner recess 37. The head 28 may be suppressed since the retaining function may be entirely performed by the annular protuberance created in the intermediate portion 29 under action of the annular projection 38. This annular protuberance with a curved profile is locked between the first edge 34 and the second edge 37*a*.

The flexed portion and optionally the head 28 of the tubular element 22 provide radial projections to secure the tubular element 22 with the upper wall 5 of the reservoir 2 in the well 6. Thus, the tubular element 22 and the upper wall 5 are assembled without screw threads making the lighter particularly easy to assemble since all that is required for the tubular element 22 to engage the upper wall 5 of the reservoir 2 is for the tubular element 22 to be introduced into the well 6 in between the upper wall 5 and to be locally flexed when the dispensing device 8 is mounted. Furthermore, since the tubular element 22 and the upper wall 5 of the reservoir do not have any screw threads, they can be manufactured using molds which allow higher production rates.

The well 6 may be provided with a simple cylindrical shape having an internal diameter d1. The outer tube 23 has a maximal external diameter d2 lower than diameter d1 and may be a standard cylindrical piece. Advantageously, the maximal thickness T of the stopping portion 30 of the tubular element 22 satisfies the following relation:

$$2*T+d2>d1$$

In the non-limitative embodiments shown in the figures, a locking mechanism is provided through the head 28 and the flexed portion of the tubular element 22. A gas apparatus and particularly a gas lighter 1 of simplified construction and suitable for a brittle reservoir material such as amorphous polymers is thus obtained.

The embodiments of the present invention have been described in connection with the preferred embodiments. These embodiments, however, are merely for example and the invention is not restricted thereto. It will be understood by those skilled in the art that other variations and modifications can easily be made within the scope of the embodiments of the invention as defined by the appended claims, thus it is only intended that the embodiments of the present invention be limited by the following claims. For instance, the invention may be implemented in any gas apparatuses provided with a dispensing device 8 and a reservoir 2.

The invention claimed is:

1. A gas lighter comprising:

a reservoir having an upper wall;

a well passing through the upper wall, the well extending along a central axis and having an inner wall;

a gas dispensing device located at least partially in the well and having an external rigid portion facing at least a part of the inner wall, the gas dispensing device being configured to allow the fuel flow out of the reservoir under selective control; and a resilient tubular element, opened at a bottom end to allow the fuel flow to the gas dispensing device, the tubular element having at least one stopping portion, the resilient tubular element being fitted into the well and the rigid portion of the gas dispensing device being inserted therein, the well having at least one first edge extending outwardly from the central axis and against which the stopping portion of the tubular element is flexed under action of the rigid portion of the gas dispensing device inserted into the resilient tubular element;

wherein the first edge is annular, and wherein the stopping portion of the resilient tubular element is in gastight contact with the annular edge of the well.

2. The gas lighter according to claim 1, wherein the first edge is oriented toward the inside of the reservoir.

3. The gas lighter according to claim 1, wherein the first edge is an inner end of the well.

4. The gas lighter according to claim 1, wherein the well has at least one second edge oriented in the opposite direction relative to the first edge, the resilient tubular element having at least one stopping portion in engagement against the second edge.

5. The gas lighter according to claim 4, wherein the second edge is facing the first edge, the first edge and second edge defining a recess in the inner wall of the well, in which the stopping portion of the tubular element is flexed under action of the rigid portion of the gas dispensing device inserted into the resilient tubular element.

6. The gas lighter according to claim 1, wherein the stopping portion defines an annular protuberance.

7. The gas lighter according to claim 1, wherein the stopping portion of the resilient tubular element protrudes inwardly in a non-mounted state, and wherein the external rigid portion is cylindrical.

8. The gas lighter according to claim 1, wherein the external rigid portion comprises a rigid annular projection.

9. The gas lighter according to claim 1, wherein the resilient tubular element comprises a cylindrical portion facing the inner wall of the well, the cylindrical portion having a constant thickness.

10. The gas lighter according to claim 1, wherein the well has a cylindrical shape that includes an internal diameter "d1", the external rigid portion of the gas dispensing device having a cylindrical shape presenting an external diameter "d2", the stopping portion of the resilient tubular element being provided with a thickness "T" and satisfying a relation 2*T+d2>d1.

11. The gas lighter according to claim 1, wherein the stopping portion of the resilient tubular element is in gastight contact with the well.

12. The gas lighter according to claim 1, wherein the resilient tubular element is one piece made of a synthetic elastomer such as thermoplastic polyester elastomer.

13. A method of mounting a gas lighter, the gas lighter comprising a reservoir intended to contain fuel and having an upper wall; a well passing through the upper wall, the well extending along a central axis and having an inner wall defining at least one first annular edge extending outwardly from the central axis; and a gas dispensing device located at least partially in the well and having an external rigid portion facing at least a part of the inner wall;

the method comprising the steps of:

inserting a resilient tubular element in the well;

inserting the gas dispensing device in the well;

flexing a stopping portion of the tubular element against the first edge under action of the rigid portion of the gas dispensing device, thereby providing a gastight contact between the tubular element and the annual edge of the well, and locking the resilient tubular element into the well through the flexed stopping portion.

14. The method according to claim 13, wherein the resilient tubular element is inserted in the well, after which the gas dispensing device is inserted in the well.

* * * * *